US007328548B2

(12) United States Patent
Waldron

(10) Patent No.: US 7,328,548 B2
(45) Date of Patent: Feb. 12, 2008

(54) DEVICES AND METHODS FOR INTRODUCING AIR INTO, OR REMOVING AIR FROM, CONTAINERS

(76) Inventor: Joseph M. Waldron, 8522 SW. 1st Pl., Gainesville, FL (US) 32607

( * ) Notice: Subject to any disclaimer, the term of this patent is extended or adjusted under 35 U.S.C. 154(b) by 96 days.

(21) Appl. No.: 11/224,506

(22) Filed: Sep. 12, 2005

(65) Prior Publication Data

US 2007/0056249 A1 Mar. 15, 2007

(51) Int. Cl.
*B65B 31/08* (2006.01)
*B65D 81/20* (2006.01)
*F16K 51/00* (2006.01)

(52) U.S. Cl. ..... 53/432; 53/434; 53/510; 53/512; 206/524.8; 215/262; 215/307; 220/231; 220/745; 220/DIG. 27; 383/3; 383/96; 383/103; 251/149.1; 137/903; 141/65; 141/66

(58) Field of Classification Search ..... 53/432–434, 53/510–512; 215/262, 307, 228; 220/231, 220/360, 367.1, DIG. 27, 212, 913, 745–750; 383/3, 96, 103; 251/149.1; 137/903; 141/65, 141/66; 206/524.8; *B65B 31/06*
See application file for complete search history.

(56) References Cited

U.S. PATENT DOCUMENTS 2,677,388 A * 5/1954 Neff ..... 383/3
RE32,354 E * 2/1987 Savage ..... 251/149.1
5,228,271 A 7/1993 Wallace
5,240,112 A 8/1993 Newburger
5,332,095 A 7/1994 Wu
5,413,230 A * 5/1995 Folter et al. ..... 215/260
5,450,963 A 9/1995 Carson
5,606,988 A * 3/1997 Pawlowski, Jr. ..... 251/149.1
5,996,800 A 12/1999 Pratt
6,039,182 A 3/2000 Light
6,059,457 A 5/2000 Sprehe et al.
6,070,397 A 6/2000 Bachhuber
6,604,634 B2 8/2003 Su
6,634,384 B2 10/2003 Skeens et al.
6,637,939 B2 10/2003 Huffer
6,712,334 B2 * 3/2004 Motonaka et al. ..... 383/103
6,964,519 B2 * 11/2005 ErkenBrack ..... 383/103
7,093,612 B2 * 8/2006 Greene et al. ..... 251/149.1
2003/0020040 A1 * 1/2003 Anderson ..... 251/149.1
2003/0111121 A1 6/2003 Skeens et al.
2004/0114837 A1 6/2004 Koyangi

* cited by examiner

*Primary Examiner*—Stephen F Gerrity
(74) *Attorney, Agent, or Firm*—Saliwanchik, Lloyd & Saliwanchik

(57) ABSTRACT

A device comprising a plug positioned within a housing to regulate air within a container, for example, plastic storage containers or bags. The plug is positioned within the housing to occlude a port hole in the housing. The housing is positioned within a container so the port hole faces a wall of the container. A hole is created in the container above the port hole. To evacuate or inject air into the container, a hose adaptor with a specialized hose tip is connected to a vacuum or air hose. When inserted into the port hole, the hose tip temporarily displaces the plug from the port hole. Vents within the housing allow air to move through the housing and into or out of the hose tip. Removal of the hose tip allows the plug to resume position over the porthole to maintain the vacuum or air pressure within the container.

21 Claims, 2 Drawing Sheets

22
18
16
14

30

29
28

20
18
16
22
14

32
30

29
28
26

32
30

DEVICES AND METHODS FOR INTRODUCING AIR INTO, OR REMOVING AIR FROM, CONTAINERS

BACKGROUND OF INVENTION

It is often desirable when packing and storing materials to reduce the amount of space within the packing containers or bags. Often, the storage space can be reduced by reducing or eliminating the amount of ambient air or other gases within the container or bag. It may also be desirable to remove the ambient air or other gases from containers in order to preserve the integrity or freshness of the packed materials. Conversely, it may be desirable to inflate containers, for example bags, with ambient air or other gases.

The device of the subject invention provides a means for evacuating or injecting air into a variety of containers. The device of the subject invention can be used with containers that may not already have a means for evacuating or injecting air. Thus, a variety of containers, for example disposable plastic wear or various storage bags, can be provided with vacuum packing capabilities or inflation with various gases or ambient air.

BRIEF SUMMARY

The subject invention provides a means for controlling the amount of air or other gases (herein referred to generally as "air") in a container. This can include evacuating air from or injecting air into a container.

The subject invention comprises a system utilizing a valve mechanism combined with a pump having a hose with a hose adaptor thereon. The hose adaptor is specially designed to work with the valve mechanism to inject air into or evacuate air from a container.

Specifically, the device utilizes a plug positioned within a housing, wherein the housing can be attached to a wall inside a container. The housing can have one or more openings that are occluded by the plug within the housing. To evacuate or inject air into the container, a hole is created in the wall of the container over, or in the vicinity of, the opening in the housing. A vacuum hose or air hose with a rigid or semi-rigid hose adaptor attached is inserted into the hole in the container and through the hole in the housing. The hose tip on the hose adaptor, upon insertion into the hole in the housing, displaces or slightly dislodges the plug from around the opening, thus allowing air to be evacuated or injected through the housing and into the container.

BRIEF DESCRIPTION OF DRAWINGS

FIG. 1A shows an isometric view of an example base of the housing.

FIG. 1B shows an isometric view of a plug that can be utilized within the housing.

FIG. 1B-1 shows an isometric view of an alternative embodiment of a plug that can be utilized within the housing.

FIG. 1C shows an isometric view of an example cap of the housing having a port hole through which a plug regulates the flow of air.

FIG. 1D is a plan view of the example base of the housing shown in FIG. 1A, as viewed from the open end.

FIG. 1E is a plan view of the example plug shown in FIG. 1B, as viewed from the bottom end.

FIG. 1F is a plan view of the example cap shown in FIG. 1C, as viewed from the open end opposite the port hole.

DETAILED DISCLOSURE

The subject invention provides a device controlling the amount of air within a container. This can include the evacuation or injection of ambient air or other gases (herein referred to as "air") into or out of various types of containers.

In one embodiment, the subject invention provides a device designed to be attached to a container in order to provide an opening through which the flow of air can be controlled into and out of the container, preferably after the container has been closed or sealed. The device of the subject invention can be modified for use with almost any type of container. For example, containers of thin plastic with firm walls or lids can be utilized with the subject invention, for example, but not limited to, Ziploc™ or Glad™ brand storage containers.

The device of the subject invention is particularly useful with air-tight bag-like containers comprising relatively thin, flexible material, for example plastic, rubber, fabric, paper, etc. In a preferred embodiment, the subject invention is utilized with self-sealing storage bags, for example, but not limited to Ziploc™ or Glad™ brand self-sealing or zipper-closing bags. When sealed, these types of storage bags create an air tight chamber. When the device of the subject invention is attached within such a bag, air can be evacuated to create a vacuum or partial vacuum within the bag. Conversely, the device can also allow air to be injected into the bag.

Figure 4:
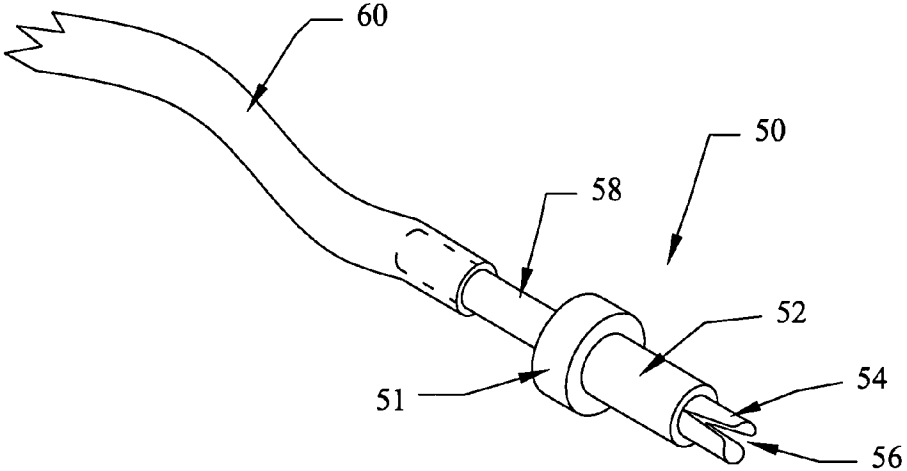
FIG. 4 is an isometric view of an example vacuum or air hose tip that can be used with the subject invention.

In one embodiment, the device of the subject invention includes a plug within a hollow housing, wherein the housing has a port hole that can be connected to a vacuum source. The housing can further be used to connect the device to a container, preferably to an inside wall or the inside of a lid, and can also aid in ensuring an air tight seal around the port hole. A specially designed hose adaptor 50, for example as show in FIG. 4, is attached to the end of a vacuum or air hose that is connected to a vacuum or air pump means. An opening or hole is created over or near the port hole 16 before or after attachment of the subject invention to the inside of a container. The hose adaptor 50 has a hose tip 54 that, for example as in FIG. 4, can be inserted through the opening created in the container and into the port hole. Upon insertion, the hose tip 54 displaces the tip of the plug away from the port hole. Once the plug is displaced, air can be evacuated from, or, alternatively, injected or blown into, the container, through the housing and into or out of the punctured hole.

Figures 1, 1A, 1B, 1C, 1D, 1E, 1F:
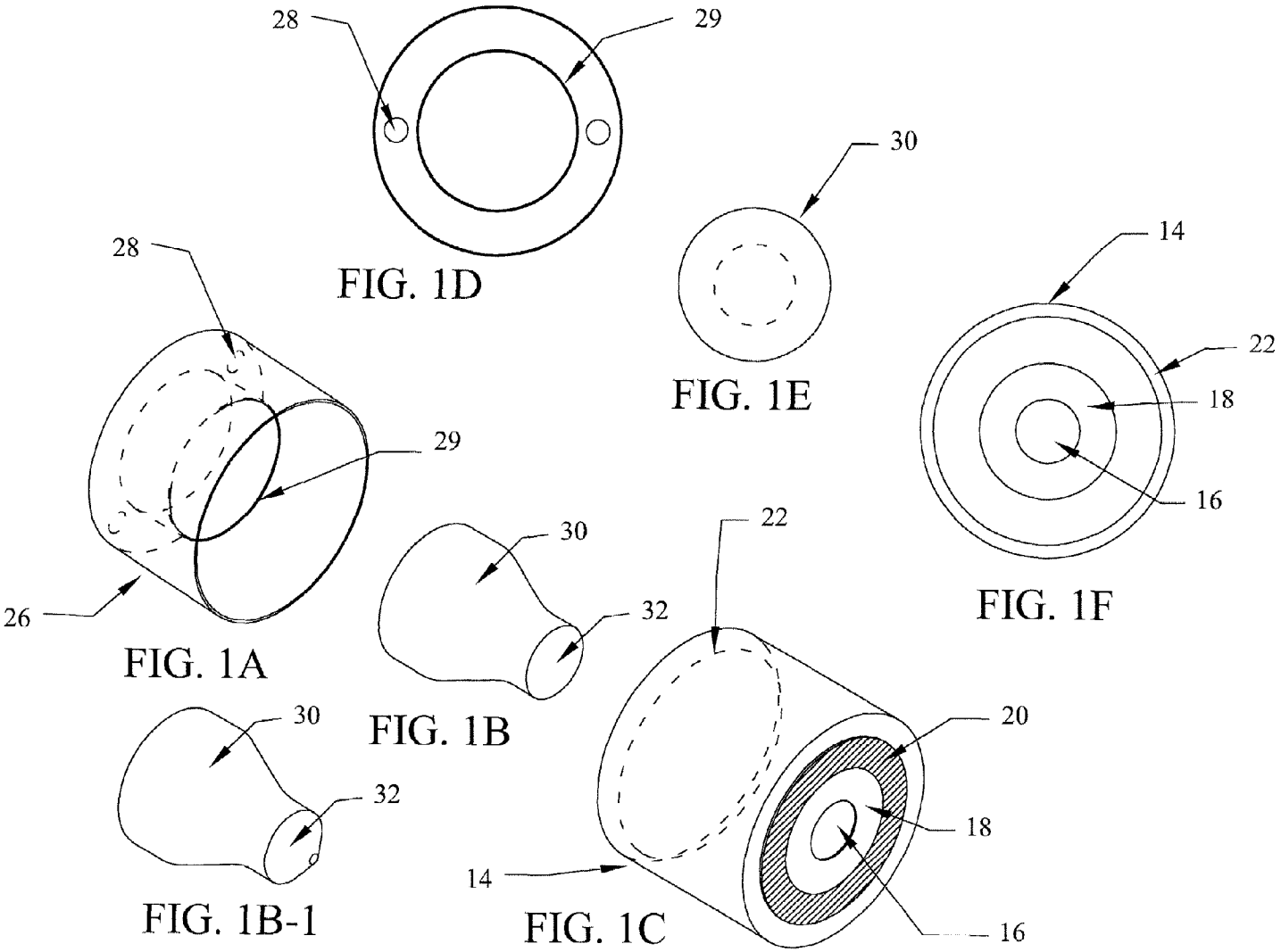

As mentioned above, the housing 12 is essentially a chamber that contains a plug 30, for example as shown in FIG. 1B. The housing can be made as one or more pieces that, when attached, form an essentially air tight seal around an opening in the container through which air will be evacuated or injected. The housing can be a variety of shapes and sizes, which could depend upon the size and shape of the container to which it will be connected. The housing 12 may also be made of a variety of materials, which, again, could depend upon the type of container to which the housing will be attached. For example, if the device of the subject invention is used in food storage containers, it may be preferable for the device to be microwaveable or oven-safe. Conversely, if the device is to be used on containers designed for freezer storage, it may be preferable to use freezer-safe materials. Thus, many types of microwave or oven-safe materials could be used, such as, for example, various plastics, rubbers, glass, metal, or alloys thereof, etc. In addition, the size of the housing will also depend upon the size of the container. The size of the device may also be dictated by the vacuum source and power thereof.

In a preferred embodiment, the housing comprises two parts, a base 26 and a cap 14, for example, as shown in FIGS. 1A, 1D, 1C and 1F. In a further preferred embodiment, the base 26 has a circumference that is smaller than the inside circumference of the cap 14. The base 26 can be slid into or otherwise positioned inside the cap 14 such that the open end of the base 26 faces the port hole 16 in the cap 14. This allows access to the hollow chamber and the plug 30 before the housing is assembled.

The base 26 and the cap 14, as exampled in FIGS. 1A, 1D, 1C and 1F, can be made to fit together using a variety of methods and techniques known in the art. For example, the base 26 and cap 14 may be glued, thermally sealed, or welded, or various snaps can be utilized, etc. It may also be desirable for the base 26 and cap 14 to be removably joined together to allow access to the inside of the housing 12 or to the plug 30, if necessary, before or after installation. In this embodiment, the base 26 and cap 14 could be screwably attached, or various snaps or other means known in the art could be used. In a preferred embodiment, the base 26 and cap 14 are held together by one or more protrusions or snap lips 22 inside the open end of the cap 14. When the base is slid into or positioned within the cap 14, the covered end of the base 26 engages with the one or more snap lips 22 on the inside of the cap, which lodge against the bottom or covered end of the base 26 to hold it in place within the cap 14. A person with skill in the art will recognize that this arrangement could easily be modified so that the lip 22 is positioned along the inside of the cap and can engage with the base via dimples, depressions, or channels into which one or more snap lips 22 can seat when the base 26 is inserted into the cap 14.

In order for air to be evacuated or injected into the container to which the device of the subject invention is attached, the housing can have one or more openings or vents 28. These vents 28 can be provided anywhere on the housing, in the cap 14 or the base 26. However, it may be preferable to provide openings in such a way that they will not be closed or otherwise interfered with by the materials within the container or by the container itself. In a preferred embodiment, one or more vents 28 are positioned at the bottom or covered end of the base 26, for example as shown in FIGS. 1A and 1D. The openings can be any number, size or shape, but should be sufficient to allow the passage of air into or out of the container. In a further preferred embodiment, the end of the base 26 where the vents are located is curved to create a convex end to the base 26. This convex end raises the vent holes so they are not covered or blocked by the material of the container or the contents therein.

As mentioned previously, the housing 12 contains a plug 30 that occludes the port hole 16 in the cap of the housing. The displacement of the end of the plug 30 away from the port hole 16 by insertion of the hose tip 54, allows air to be evacuated or injected into the container, through the vents 28 and into the housing 12. In order to prevent the entire plug from being displaced within the housing when the hose tip 54 is inserted, the plug 30 can be secured to the inside of the base 26. The plug 30 can be fixedly attached to the base 26 using a variety of techniques known in the art, including glues, thermal sealing, screwing, snapping into place, etc. However, it may be desirable to change, alter or otherwise adjust the plug 30 used in the device of the subject invention. As mentioned previously, depending upon the type of container the device is used with, or the materials therein, it may be necessary to use plugs 30 of different styles, shapes, or materials. Thus, in a preferred embodiment, the plug is removably attached to the base 26. In a further preferred embodiment, a plug seat 29 is positioned inside the base on the bottom or closed end, for example as shown in FIGS. 1A and 1D. In a still further preferred embodiment, plug 30 is seated within and held in place by the plug seat 29. When the base 26, with the plug 30 in place within the plug seat 29, is positioned inside the cap 14, the top of the plug becomes pressed against, and occludes, the port hole 16. In a further preferred embodiment, the plug seat 29 is able to maintain the plug in a stable position within the housing 12 even when the top of the plug 30 is displaced by the hose tip 54. In a still further preferred embodiment, the walls of the plug seat are approximately 2 millimeters to approximately 5 millimeters in height.

The plug 30 of the device of the subject invention regulates the flow of air into and out of the housing 12 and, thus, the container to which the device is attached. In a preferred embodiment, the device of the subject invention is designed to be used multiple times. Therefore, the plug material should be durable, yet flexible with sufficient elastic memory to quickly reposition itself against the port hole 16 numerous times after repeated insertion and removal of the hose tip 54. It may also be necessary to consider the environments to which the device of the subject invention will be subjected during use. High heat applications or severe cold applications may dictate the type of material used for the plug. The plug may also comprise more than one material. For example, the bottom of the plug may be of one material, for example, but not limited to, a rigid plastic material, wood, etc., to which is attached a flexible tip end 32 made of another material, for example, but not limited to, pliable plastics, rubber, silicone, etc. In a preferred embodiment, the plug 30 comprises a rubber-like material that is microwave safe and cold tolerant.

Figure 3:
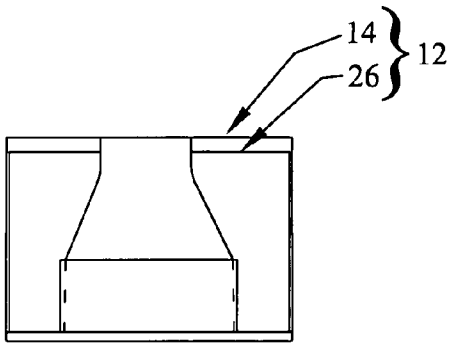
FIG. 3 is an elevational view of the device of the subject invention, wherein the front portion of the housing has been removed to show the interior cavity, an example plug seat, and an example plug.

The circumferential shape of the plug 30 can be any of a variety of shapes, for example, but not limited to, circular, oval, square, triangular, or any other polygonal shape, and may also vary along the length of the plug, if necessary. But, it should be of sufficient length to reach the port hole 16 from the plug seat 29, the base of the housing, or other support structure that may be utilized and have sufficient tension on the port hole 16 to prevent any unwanted passage of air through the port hole 16, as illustrated in FIG. 3. In a preferred embodiment, the plug 30 has a circular circumference along its length. In a further preferred embodiment, the plug 30 is larger at the base end that fits within the plug seat 29, to provide additional stability. In still a further preferred embodiment, the plug 30 tapers towards the tip end 32 that occludes the port hole 16, for example as shown in FIGS. 1B and 1E, such that the circumference of the tip end 32 is smaller than the base end, but is sufficiently large enough to cover the circumference of the port hole 16, as shown in FIG. 3. In an alternative embodiment, the tip end 32 is convex or rounded, as shown, for example, in FIG. 1B-1, so that it can more effectively occlude the port hole. Such a convex tip would allow the tip end to protrude slightly into the port hole. This can ensure a complete seal around the port hole by the circumference of the tip end 32.

The cap 14 of the subject invention is connected to the base 26, as discussed above. The cap 14 contains an opening or port hole 16 through which the vacuum or air tube 60 can be inserted. It is the end of the cap 14 with the port hole 16 that attaches to the inside wall of a container. The cap 14 of the subject invention can be attached to a container in a variety of ways known to those with skill in the art. The method of attachment should ensure an essentially air tight seal so that air cannot enter or escape from the container after the vacuum or air tube is removed from the port hole 16. For example, the cap can be thermally sealed to the container or glued to the container. In one embodiment, the cap is thermally sealed to the container during the manufacturing process. And, in still a further embodiment, during the manufacture of containers, openings can be pre-made in one or more walls or lids of the containers to allow access to the port hole 16 after attachment of the housing of the subject invention to the inside walls of said containers. In a preferred embodiment, a concentric ring of adhesive material 20 surrounds the port hole 16. The ring of adhesive material 20 can be pressed against the wall of the container to attach the housing 12 to the container and to create an air tight seal around the port hole 16. There are numerous kinds of adhesive that could be utilized with the subject invention. Furthermore, this method of attachment allows the device of the subject invention to be utilized with containers comprising a variety of materials.

Figure 2A:
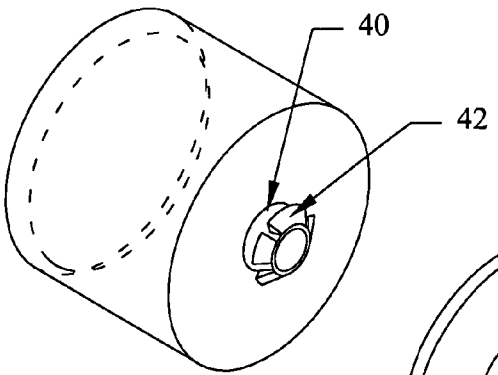
FIG. 2A is an isometric view of an alternative embodiment of a cap that can be utilized with the housing of the subject invention. This embodiment utilizes a lock washer that can be secured to a stem on the cap to hold the device of the subject invention onto a container.
Figure 2B:
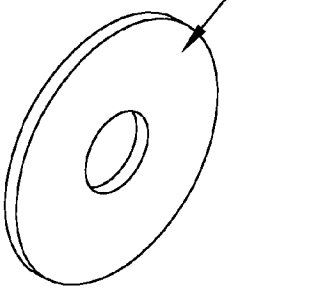
FIG. 2B is an isometric view of an example lock washer that can be used with the embodiment shown in FIG. 2A.

In another embodiment, the port hole 16 may be surrounded by a stem 40 to which are fixedly attached teeth or pawls 42, as shown in FIG. 2A, for receiving and securing a lock washer 44, as shown in FIG. 2B. In operation, the stem 40 is inserted through a hole made in the container so that the wall of the container is pressed against the top of the cap 14 and around the stem 40. Once in position, a lock washer 44 can be pushed or pressed over the pawls 42 on the stem 40. Once the lock washer 44 is pushed far enough, the pawls 42 hold the lock washer in place against the side of the container opposite the top of the cap 14. In this way, the wall of the container becomes pressed between the cap 14, inside the container, and the lock washer 40, on the outside of the container. It can be appreciated that in this embodiment the stem 40 should be of sufficient length to receive the lock washer 44, and the pawls 42 should ensure that it is held securely against the side of the container against the cap so that an air tight seal can be achieved and maintained.

A person with skill in the art would readily recognize that this arrangement could be modified in a variety of ways. For example, the lock washer 40 and stem 40 could have opposite threading such that the lock washer 40 could be screwed onto the stem 40, or variations thereof. The stem 40 and lock washer 44 means could also be utilized in conjunction with an adhesive, such as the ones described above, or other insulating means or materials that would aid or ensure that an air tight seal is achieved around the port hole 16. Likewise, the lock washer 44 could be modified to have ridges or other protrusions on one or both sides or around the edges that could be pressed into the surface of the container to aid in securing an air tight seal when the lock washer is positioned over the stem 40.

In a preferred embodiment, the port hole 16 is located within the cap 14 of the device of the subject invention. The port hole 16 is designed to receive the hose tip 54 on the end of the hose adaptor 50. The port hole 16 is essentially a hole in the cap 14 that can be of various sizes or shapes, depending upon the configuration of the hose adaptor. There may also be more than one port hole, or the port hole can be divided in order to better receive a variety of hose adaptors that can be utilized with the subject invention. In one embodiment the area around the port hole 16 is slightly raised or cupped above the level of the cap end, causing a slightly concave surface within the cap around the port hole. Alternatively, the area within the cap around the port hole 16 can be manufactured with a slightly concave surface without raising the area around the port hole above the level of the cap end. This slight concavity around the port hole 16 can aid in the repositioning of the tip end 32 of the plug to occlude the port hole when it is displaced from around the port hole. As mentioned above, the port hole 16 may be surrounded by a neck or stem 40 to secure the device to a container. One with skill in the art would recognize that the port hole 16 can be modified in a variety of ways in order to properly receive a hose tip 54 or other means for evacuating or injecting air into a container.

In a preferred embodiment, the port hole 16 is a single opening within the top of the cap 14. In a still further preferred embodiment, the material surrounding the port hole 16 is a soft but firm material 18 that can conform to the size and circumferential shape of the hose tip 54.

A hose adaptor 50 provides a means for connecting or inserting the vacuum or air hose 60 to the port hole 16. In one embodiment, the hose adaptor 50, for example as shown in FIG. 4, has a tube 58, or other means, at one end for attaching to a vacuum or air hose. The hose adaptor also has a hose tip 54 that can insert into the port hole 16 within the cap 14 of the subject invention. In a preferred embodiment, the hose tip 54 is sufficiently rigid to displace the plug from the port hole 16 so that air can be evacuated or injected into the housing 12, and, thus, into a container. In a further preferred embodiment, the hose tip 54 has slots or grooves 56 to facilitate air flow through the hose tip 54 and around the plug. An example of a slotted or grooved 56 hose tip 54 is illustrated in FIG. 4.

It can also be advantageous to ensure that the hose tip 54 and the port hole 16 are of similar diameter, such that a snug, essentially air tight seal can be achieved when the hose tip 54 is inserted into the port hole 16. The hose tip 54 may also comprise or be covered, entirely or partially, with a pliable or semi-pliable material capable of conforming to the shape of the port hole 16 to aid in obtaining a sufficient seal. In a preferred embodiment, the diameter of the hose tip 54 is smaller than the diameter of the port hole 16, but only sufficiently so to allow the hose tip 54 to be inserted into the port hole 16 without damaging the port hole, but still provide a snug, relatively air tight seal.

The hose tip 54 should be of sufficient length to displace the plug 30. If the hose tip 54 is provided with any slots or grooves 56, the hose tip should be inserted into the port hole 16 a distance sufficient to ensure that the slots or grooves 56 are within the housing. However, to prevent damage to the plug, housing or other components of the device, the hose tip 54 should not be inserted an unnecessary distance into the housing 12. Therefore, a gauge or stop device 52, for example as shown in FIG. 4, could be utilized to ensure that the hose tip 54 is not inserted beyond the point necessary to displace the plug 30 and provide a sufficient seal around the port hole 16. In a preferred embodiment, a stop gauge 52 is utilized on the hose adaptor 50 to allow only the required portion of the hose tip 54 to be inserted into the port hole 16.

The hose adaptor 50 may also be modified to have various means for gripping or holding the hose adaptor 50 and/or the vacuum or air hose, both during use and for storage of the hose adapter 50. For example, various types of grooves or grips can be utilized with the hose adaptor 50. In a preferred embodiment, a rigid or semi-rigid grip 51 is fixedly attached to the hose adaptor 50 above the stop gauge 52. This grip 51 can be used for holding or gripping the hose adaptor 50 during use, and/or as a means for securing the end of the vacuum or air hose 60 when not in use.

The vacuum or air source utilized with the subject invention can be obtained or created through a variety of methods known to those with skill in the art. As mentioned above, in one embodiment, the device of the subject invention is utilized with standard storage containers or plastic, self-sealing bags generally used for storing food or other relatively small items. Thus, it may only be necessary to have or use a vacuum or air source capable of evacuating or injecting air into such standard, well-known containers. For example, a standard electric vacuum or air pump of sufficient power could be utilized with the subject invention.

It may also be possible to utilize the motor and/or electrical components in an already existing appliance normally utilized in a home, restaurant or business environment. For example, a vacuum pump, air pump, or combination thereof, can be integrally attached to or contained within an already existing countertop appliance or device. The electrical components of the appliance can be made to jointly operate and service the appliance, as well as a pump. This arrangement would also save space because a separate appliance would not be required.

In a preferred embodiment, the components within a standard electric counter-top appliance, for example, but not limited to, a can-opener, blender, mixer, microwave, coffee pot, toaster, timer, clock, etc., are utilized to operate a vacuum or air pressure pump for use with the subject invention. In a further preferred embodiment, the pump is contained within the housing of a said appliance. In a still further preferred embodiment, the motor and/or electrical components of the appliance are modified to jointly operate the existing appliance, as well as the pump to be utilized with the device of the subject invention. In still a further preferred embodiment, a switch connected to the appliance can be used to control, or toggle between, the two or more functions, including the pump, of the appliance.

Following are examples which exemplify certain embodiments of the subject invention. These examples are illustrative and should not be construed as limiting the subject invention in any manner.

EXAMPLE 1

An embodiment of the device of the subject invention utilizes a rigid circular, essentially hollow, housing approximately 0.5 cm high and 2 cm in diameter. The housing comprises two components, a base and a cap, wherein the base can be inserted into the cap and snap lips on the cap hold the base within the cap. The cap further comprises a circular port hole surrounded by a more pliable material than the main portion of the cap. The port hole is approximately 4-5 mm in diameter. A circular rubber-like plug is utilized within the housing. Further, a circular plug seat approximately 3-4 mm high is fixedly attached to the center of the inside floor of the base.

The device can be provided with a selection of plug styles. After selection of the appropriate plug, the plug is seated within the plug seat, prior to insertion of the base into the cap, to prevent sliding or other movement of the plug within the housing. When the housing is assembled with the plug positioned in the plug seat, the plug extends from the plug seat to the circular port hole, so that the plug can fully occlude the port hole with sufficient tension around the port hole to prevent unwanted intrusion or escape of air. In this embodiment, the plug should be approximately 1.5 cm in diameter at the base and taper towards the port hole to a diameter of approximately 9 to 10 mm. in diameter.

In order for air to be moved into or out of the housing, one or more openings or vents are provided at the bottom end of the base around the perimeter of the plug seat. The vents allow air into or out of the housing. The base of the device is slightly convex so that the vents are not positioned on a flat surface. This can help prevent materials within the container from blocking or interfering with the vents.

The assembled device of the subject invention, is attached to the inside wall of a storage container or storage bag. A concentric strip of sticky adhesive around the perimeter of the port hole, protected by a peelable paper seal, is utilized to stick the housing to the inside flattened wall of a storage container or storage bag. Either before or after installation of the device, a hole can then be created in the bag above or in the vicinity of the port hole so that the hose tip can be inserted through the hole in the bag and into the port hole. If desired, the hole in the bag can be made by using the hose tip and simply pushing it through the wall of the container and into the port hole, or another device can be utilized that will not damage any other part of the bag, the port hole or the device of the subject invention.

A standard vacuum or air pump can be utilized to evacuate or inject air into the container. However, the subject invention utilizes a specialized vacuum hose adaptor to connect the pump hose to the device of the subject invention. The hose adaptor connects to one end of the pliable vacuum hose, preferably by a tubular projection that is forced into the end of the vacuum hose causing the hose to expand around the tube to form a seal. The opposite end of the hose adaptor has a hose tip. The hose tip is inserted into the port hole to displace the plug from around the port hole. When the vacuum or air pump is turned on, air travels between the vents and the hose tip through the housing.

EXAMPLE 2

A further embodiment of the subject invention utilizes a housing, as described in Example 1. However, the port hole in this embodiment is surrounded by a stem approximately 3 to 4 mm high from the top of the cap. A hole can be created in the bag or other container prior to installation. The device of the subject invention is positioned inside the container so that the stem around the port hole can be inserted through the hole made in the container, such that the stem protrudes to the outside of the container. The stem is designed to accept a lock washer, wherein the lock washer is pushed over the stem and secured around the stem. Thus, when assembled, the wall of the bag or container is sandwiched between the top of the cap inside the container and the lock washer on the outside of the container. The stem has pawls or one-way teeth that allow the lock washer to be pushed over the stem and prevent the lock washer from being removed from the stem. Further, the pawls or one-way teeth hold the lock washer against the wall of the container securely, so as to form an air tight seal around the hole through which the stem is protruding from the container.

In this embodiment, the hose tip would need to be longer in order to extend through the stem and displace the plug around the port hole located inside the base of the stem.

It should be understood that the examples and embodiments described herein are for illustrative purposes only and that various modifications or changes in light thereof will be suggested to persons skilled in the art and are to be included within the spirit and purview of this application.

The invention claimed is:

1. A device for controlling the amount of air within a container, wherein said device comprises:

a housing having at least two openings to facilitate the movement of air into or out of the housing, wherein at least one of the openings is for receiving a means for actively injecting air into or evacuating air from a container;

a plug positioned and confined within said housing such that one end of the plug occludes said at least one opening in the housing that receives the means for injecting or evacuating air, wherein at least a portion of the plug end that occludes said at least one opening comprises a material being sufficiently elastic so as to be displaced from said at least one opening, while the plug remains confined within the housing, when said means for injecting or evacuating air is introduced into said at least one opening; and a connecting means affixed to the exterior of said housing for connecting said housing to a container so that an essentially air tight seal is formed around the at least one opening that receives the means for injecting or evacuating air;

such that in use said housing is connected to a wall of the container so that said means for injecting or evacuating air can be inserted past the wall of the container and into the at least one opening in the housing so as to displace the plug end that occludes the at least one opening to allow the movement of air into or out of the container, while the plug remains confined within the housing.

2. The device, according to claim 1, wherein the plug end that occludes the at least one opening is convex.

3. The device, according to claim 1, wherein said means for connecting the housing to the container comprises an essentially air tight thermal seal around said at least one opening that receives said means for injecting or evacuating air.

4. The device, according to claim 1, wherein said means for connecting the housing to the container comprises a lock and washer mechanism that forms an essentially air tight seal around the at least one opening that receives the means for injecting or evacuating air, or wherein the means for connecting the housing to the container comprises an adhesive strip disposed around the at least one opening that receives the means for injecting or evacuating air such that said adhesive strip forms an essentially air tight seal.

5. The device, according to claim 1, wherein said housing comprises two or more connectable parts.

6. The device, according to claim 5, wherein said housing comprises a base part that can be slidably connected to a cap part.

7. The device, according to claim 6, further comprising a plug seat connectably attached to the base part, wherein the plug is disposed within the plug seat prior to the base part being slidably connected to the cap part.

8. The device, according to claim 7, wherein the walls of said plug seat are approximately 2 millimeters to about 5 millimeters in height.

9. The device, according to claim 7, wherein the periphery of said plug seat is compatible with the periphery of at least that portion of the plug that will be positioned within the plug seat so as to limit or prevent unnecessary movement of the plug within the housing.

10. The device, according to claim 6, wherein the cap part of said housing comprises at least one opening for receiving the means for injecting or evacuating air from a container to which the cap part of said housing is attached.

11. The device, according to claim 10, wherein said at least one opening on the cap part further comprise a flexible elastic material around said at least one opening capable of forming an essentially air tight seal between said at least one opening and said means for injecting or evacuating air from a container.

12. The device, according to claim 11, wherein said cap part of said housing further comprises a snap mechanism for securing said base part to said cap part after they are slidably connected.

13. The device, according to claim 12, wherein said cap and base parts, when connected, form a housing approximately 0.5 centimeter to about 1 centimeter in height and approximately 2 centimeters to about 5 centimeters in diameter.

14. The device, according to claim 10, wherein said base part comprises at least one opening to facilitate the movement of air from a container into said housing.

15. The device, according to claim 14, wherein the at least one opening is positioned on the base part so that the flow of air into and out of said at least one opening is not blocked when the base part is slidably connected to the cap part.

16. The device, according to claim 15, wherein that portion of said base part on which said at least one opening is positioned is essentially convex.

17. The device according to claim 1, further comprising a hose adaptor having at least two open ends, wherein at least one end is connected to the means by which air is actively injected into or evacuated from a container, and at least one other end can be inserted into the at least one opening in the housing to displace the end of the plug that occludes said at least one opening, while the plug remains confined within the housing.

18. The device, according to claim 17, wherein the hose adaptor further comprises a hose tip having sufficient rigidity to puncture the wall of the container in order to obtain said access to the at least one opening in the housing.

19. A method for controlling the amount of air within a container using a device comprising:

a housing having two or more openings to facilitate the movement of air into or out of the housing, wherein at least one of the openings provides contact with the outside of the container;

a plug stably positioned and confined within the housing such that one end of the plug occludes the at least one opening that provides contact with the outside of the container, wherein a portion of the plug end that occludes said at least one opening comprises a sufficiently flexible material capable of being displaced from the at least one opening;

a connecting means on the exterior of the housing for connecting the housing to the container so that an essentially air tight seal is formed around the at least one opening that provides contact with the outside of the container; and a hose adaptor having at least two open ends, wherein at least one end is connected to a means by which air is actively injected into or evacuated from a container, and the other end, when inserted into the at least one opening in the housing in contact with the outside of the container, displaces the end of the plug that occludes said at least one opening, while the plug remains confined within the housing;

wherein said method comprises connecting said housing to an inside surface of a wall of the container so that said hose adaptor can be inserted past the wall of the container and into the at least one opening in the housing so as to displace the plug end that occludes the at least one opening to allow the movement of air into or out of the container by use of the means by which air is actively injected into or evacuated from a container, while the plug remains confined within the housing.

20. A kit comprising:

a) a device for controlling the amount of air within a container, said device comprising:

a housing having at least two openings to facilitate the movement of air into or out of the housing, wherein at least one of the openings is for receiving a means for injecting or evacuating air from a container;

a plug positioned and confined within said housing such that one end of the plug occludes said at least one opening in the housing that receives the means for injecting or evacuating air, wherein a portion of the plug end that occludes said at least one opening is sufficiently elastic so as to be displaced from said at least one opening, while the plug remains confined within the housing, when said means for injecting or evacuating air is introduced into said at least one opening;

a connecting means on the exterior of said housing for connecting said housing to the container so that an essentially air tight seal is formed around the at least one opening that receives the means for injecting or evacuating air;

such that in use said housing is connected to an inside surface of a wall of the container so that said means for injecting or evacuating air can be inserted past the wall of the container and into the at least one opening in the housing so as to displace the plug end that occludes the at least one opening to allow the movement of air into or out of the container, while the plug remains confined within the housing;

b) a hose adaptor having at least two open ends, wherein at least one end is connected to the means for injecting or evacuating air, and the other end, when inserted into the at least one opening in the housing, displaces the end of the plug that occludes said at least one opening, while the plug remains confined within the housing; and c) said means for injecting or evacuating air comprises a pump for actively injecting air into or evacuating air from a container.

21. A container comprising a device for controlling the air within said container, wherein said device comprises:

a housing having at least two openings to facilitate the movement of air into or out of the housing, wherein at least one of the openings is for receiving a means for actively injecting air into or evacuating air from a container;

a plug stably positioned and confined within said housing such that one end of the plug occludes said at least one opening in the housing that receives the means for actively injecting air into or evacuating air from a container, wherein a portion of the plug end that occludes said at least one opening comprises a sufficiently flexible material capable of being displaced from said opening, while said plug remains confined within said housing, when said means for actively injecting air into or evacuating air from a container is introduced into said at least one opening; and a connecting means on the exterior of said housing for connecting said housing to said container so that an essentially air tight seal is formed around the at least one opening that receives the means for actively injecting air into or evacuating air from a container.

* * * * *